US006591240B1

(12) United States Patent
Abe

(10) Patent No.: US 6,591,240 B1
(45) **Date of Patent: *Jul. 8, 2003**

(54) SPEECH SIGNAL MODIFICATION AND CONCATENATION METHOD BY GRADUALLY CHANGING SPEECH PARAMETERS

(75) Inventor: Masanobu Abe, Yokohama (JP)

(73) Assignee: Nippon Telegraph and Telephone Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/721,577

(22) Filed: Sep. 25, 1996

(30) Foreign Application Priority Data

Sep. 26, 1995 (JP) ..... 7-248144

(51) Int. Cl.[7] ..... G10L 21/00
(52) U.S. Cl. ..... 704/278; 704/270
(58) Field of Search ..... 704/258, 265, 704/266, 268, 269

(56) References Cited

U.S. PATENT DOCUMENTS 3,828,132 A * 8/1974 Flanagan et al. ..... 704/268
4,384,169 A * 5/1983 Mozer et al. ..... 704/206

(List continued on next page.)

FOREIGN PATENT DOCUMENTS

JP 61-103200 5/1986
JP 7-104791 4/1995
JP 8-016183 1/1996
JP 8-328575 12/1996
JP 9-050295 2/1997

OTHER PUBLICATIONS

Masanobu Abe, "Speech Morphing by Gradually Changing Fundamental Frequency and Spectra", Proceedings of the Acoustical Society of Japan, pp. 259–260, Sep. 27, 1996 (Abstract of the proceedings is attached).

Eric Moulines et al., "Pitch–Synchronous Waveform Processing Techniques for Text–to–Speech Synthesis Using Diphones", Speech Communication 9 (1990) pp. 453–467.

Japanese Office Action dated Oct. 22, 2002.

*Primary Examiner*—Richemond Dorvil
*Assistant Examiner*—Michael N. Opsasnick
(74) *Attorney, Agent, or Firm*—Finnegan, Henderson, Farabow, Garrett & Dunner, L.L.P.

(57) ABSTRACT

A speech signal modification and concatenation method is provided, in which spoken messages having different voice characteristics can be concatenated without causing a sense of incompatibility, and it is possible to efficiently perform addition or modification of spoken messages. In the speech signal modification and concatenation method, when two speech signals having different voice characteristics are concatenated, the speech signals are concatenated by modifying a parameter indicating a character of speech signals in a manner such that the parameter is gradually changed from a value indicating a feature of one of the speech signals to a value indicating a feature of the other speech signal over a predetermined period. Accordingly, a time-scaled change of a feature amount of spoken sounds can be performed; thus, even if two speech signals of different speakers are concatenated, it is possible to avoid an abrupt change of voice characteristics in the concatenation section, and thus possible to concatenate speech signals without causing a sense of incompatibility to listeners.

12 Claims, 8 Drawing Sheets

U.S. PATENT DOCUMENTS 4,601,052 A * 7/1986 Saito et al. ..... 704/265
4,624,012 A * 11/1986 Lin et al. ..... 704/261
4,850,022 A * 7/1989 Honda et al. ..... 704/207
5,189,701 A * 2/1993 Jain ..... 704/207
5,226,108 A * 7/1993 Hardwick et al. ..... 704/200
5,278,943 A * 1/1994 Gasper et al. ..... 704/200
5,479,564 A * 12/1995 Vogten et al. ..... 704/267
5,504,834 A * 4/1996 Fette et al. ..... 704/207
5,517,595 A * 5/1996 Kleijn ..... 704/205
5,524,172 A * 6/1996 Hamon ..... 704/268
5,577,159 A * 11/1996 Shoham ..... 704/206
5,617,507 A * 4/1997 Lee et al. ..... 704/200
5,623,575 A * 4/1997 Fette et al. ..... 704/265
5,641,927 A * 6/1997 Pawate et al. ..... 84/609
5,663,517 A * 9/1997 Oppenheim ..... 84/649
5,703,311 A * 12/1997 Ohta ..... 84/622
5,749,073 A * 5/1998 Slaney ..... 704/278

* cited by examiner 0
3000
6000
[Hz]
α

[Hz]
6000
4000
2000
0
1ST SPEAKER
0 0.2 0.4 0.6 0.8 1.0 1.2 1.4 1.6 1.8 2.0 2.2 2.4 2.6 2.8 3.0 3.2 [SEC]

[Hz]
6000
4000
2000
0
2ND SPEAKER
0 0.2 0.4 0.6 0.8 1.0 1.2 1.4 1.6 1.8 2.0 2.2 2.4 2.6 2.8 3.0 [SEC]

[Hz]
6000
4000
2000
0
SYNTHESIZED VOICE
105
1ST SPEAKER
MODIFICATION AND CONCATENATION SECTION
2ND SPEAKER
0 0.2 0.4 0.6 0.8 1.0 1.2 1.4 1.6 1.8 2.0 2.2 2.4 2.6 2.8 3.0 3.2 [SEC]

SPEECH SIGNAL MODIFICATION AND CONCATENATION METHOD BY GRADUALLY CHANGING SPEECH PARAMETERS

BACKGROUND OF THE INVENTION

1. Field of the Invention

The present invention relates to a speech signal modification and concatenation method used in forming a spoken message by using sound-recording and editing techniques, for efficiently performing addition or modification of spoken messages, so as to establish and economically maintain a system using spoken messages.

2. Description of the Related Art

Recently, spoken messages are used in services such as announcements in stations; highway radio-announcements for providing information about traffic jams and the like; and voice guidance systems for information searches. Such spoken messages are formed by previously recording spoken sounds produced by a human, and then concatenating these sounds.

In forming spoken messages in this way, in a case in which a new message which differs from any already-formed messages was required, and if the "new" message had not yet been recorded, additional recording of any new spoken sounds was necessary.

In such a case, it was necessary for the same person who previously produced the already-recorded spoken sounds to produce additional spoken sounds in order to avoid an abrupt change of voice characteristics between the already-recorded voice and the newly-recorded voice, and to naturally concatenate the two voices.

However, even if the speaker were the same, the voice characteristics may be different from those at the time of the previous recording due to the passage of time since the previous recording, and the like. Therefore, if any comprehension difficulty due to concatenation of old and new spoken messages were expected, re-recording and re-forming of all relevant spoken messages was required.

In addition, if the previous speaker were absent, it was necessary for another speaker to produce the necessary spoken sounds instead, wherein re-recording of all relevant spoken messages was required.

Furthermore, it is also possible to form those spoken messages by using a speech-synthesis device. However, also in this case, similar problems may appear when two speech signals having different voice characteristics, due to, for example, having used different speech-synthesis devices, are concatenated.

SUMMARY OF THE INVENTION

The present invention was made in consideration of the above problems, and it is an object of the present invention to provide a speech signal modification and concatenation method for combining spoken messages having different voice characteristics, without causing a sense of incompatibility, and for making it possible to efficiently perform addition or modification of spoken messages.

Accordingly, the present invention provides: a speech signal modification and concatenation method for concatenating two speech signals having different voice characteristics, the method comprising the step of concatenating the speech signals by modifying a parameter indicating a character of speech signals in a manner such that the parameter is gradually changed from a value indicating a feature of one of the speech signals to a value indicating a feature of the other speech signal over a predetermined period.

Even if voice characteristics of the speakers are significantly different, listeners do not sense substantial incompatibility if the amount of modification per unit of time is relatively small. According to the present invention, it is possible to concatenate voices by repeating a measure of modification, which does not produce a sense of incompatibility, a plurality of times. That is, in a concatenation section of a spoken message, which is concatenated according to the present invention, the voice characteristic thereof gradually changes over a period.

As the above parameter, a spectrum of spoken sounds or a fundamental frequency of spoken sounds may be used, and the rate of changing the parameter can be arbitrarily set. For example, if the spectrum of speech signals is used as the parameter, it is possible to adopt a method comprising the steps of: in a phoneme which corresponds to the two speech signals, determining each pitch correspondence between the two signals; generating a spectrum, for every corresponding pitch, by combining, with respect to a boundary frequency, a portion above the boundary frequency among the spectrum of one speech signal and a portion below the boundary frequency among the spectrum of the other speech signal, and determining the generated spectrum as a spectrum at the relevant pitch; and with respect to the generation of spectra, changing the boundary frequency for each unit time. Here, if the change of the boundary frequency is performed such that the boundary frequency gradually increases from a value at the start of change to a value at the end of change; the rate of change is lower in a stage of relatively low boundary frequencies near the start of change, while the rate of change is higher in a stage of relatively high boundary frequencies near the end of change, a more natural voice (characteristic) change can be realized, and the change further matches the characteristics of the sense of hearing of humans.

That is, according to the present invention, a time-scaled change of a feature-amount of spoken sounds can be performed. As a result, even if two speech signals of different speakers are concatenated, it is possible to avoid an abrupt change of voice characteristics in the concatenation section, and it is thus possible to concatenate speech signals without causing a sense of incompatibility to listeners.

DESCRIPTION OF THE PREFERRED EMBODIMENTS

Hereinafter, an embodiment according to the present invention will be explained with reference to the drawings.

Figures 1A, 1B, 1C:
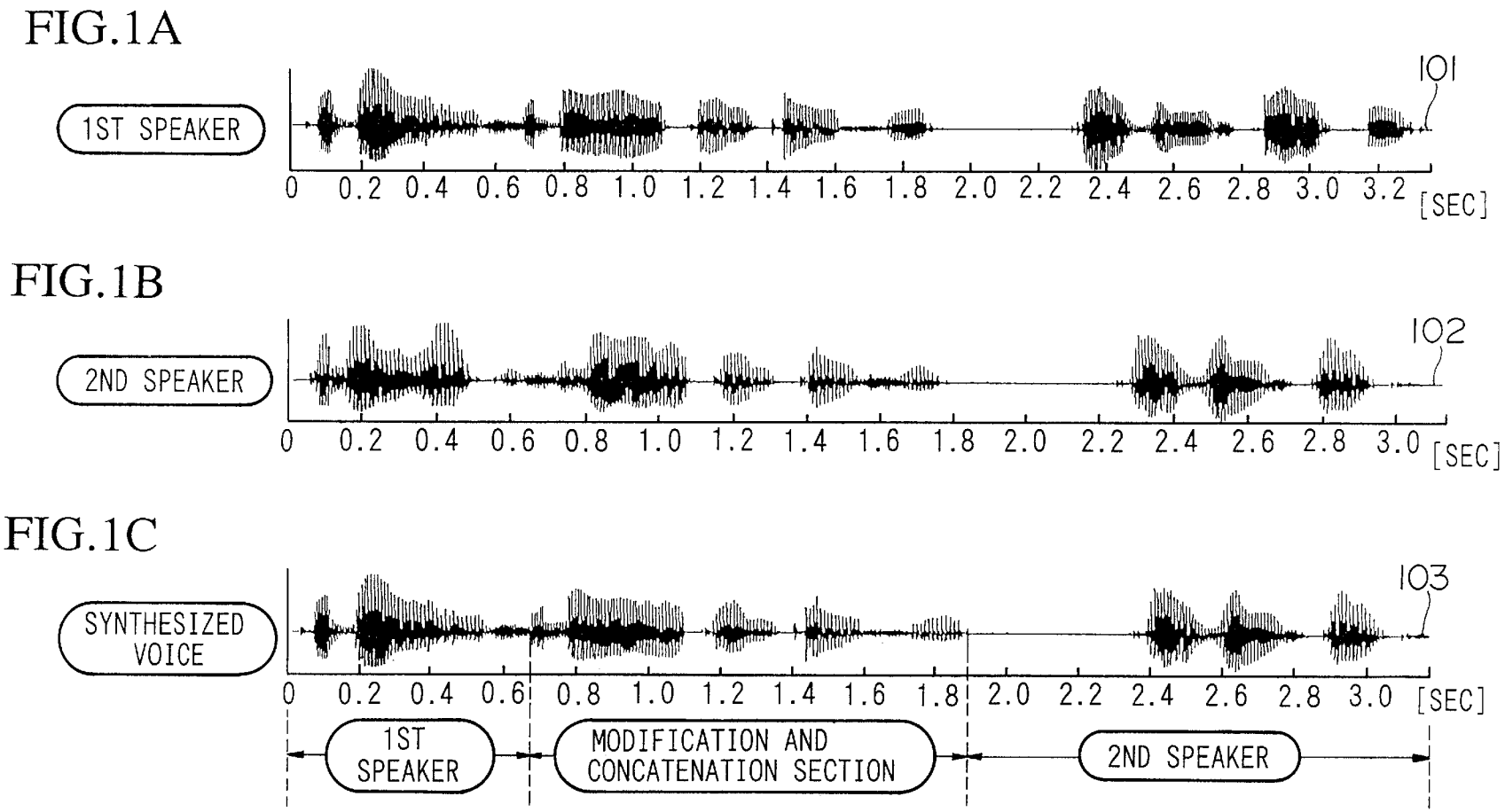
FIGS. 1A–1C are waveform charts for showing a relationship between waveforms of two speech signals having different voice characteristics, and a waveform of a speech signal which is obtained by modifying and concatenating the above speech signals in an embodiment of the present invention.

FIGS. 1A–1C are waveform charts for showing a relationship between waveforms (101 and 102) of speech signals obtained by two speakers having different voice characteristics, and a waveform (103) of a speech signal which is obtained by modifying and concatenating the above speech signals.

In the procedure of the present embodiment, two speech signals, obtained by having two speakers read the same text aloud (refer to 101 and 102 of FIG. 1), are concatenated.

The speech signal generated by the modification and concatenation procedure consists of (i) a speech block of the first speaker, (ii) a modification and concatenation block, and (iii) a speech block of the second speaker, as indicated by reference numeral 103 in FIG. 1.

In this example, two speakers were instructed to read the same text aloud; however, it is not always necessary that the text be the same. For example, in the embodiment explained below, a fundamental frequency and a spectrum are used as parameters indicating the characteristics of the voice, and the modification based on the two parameters are performed; however, if only the fundamental frequency is modified, the text read aloud by each of the two speakers may be different.

Figure 2:
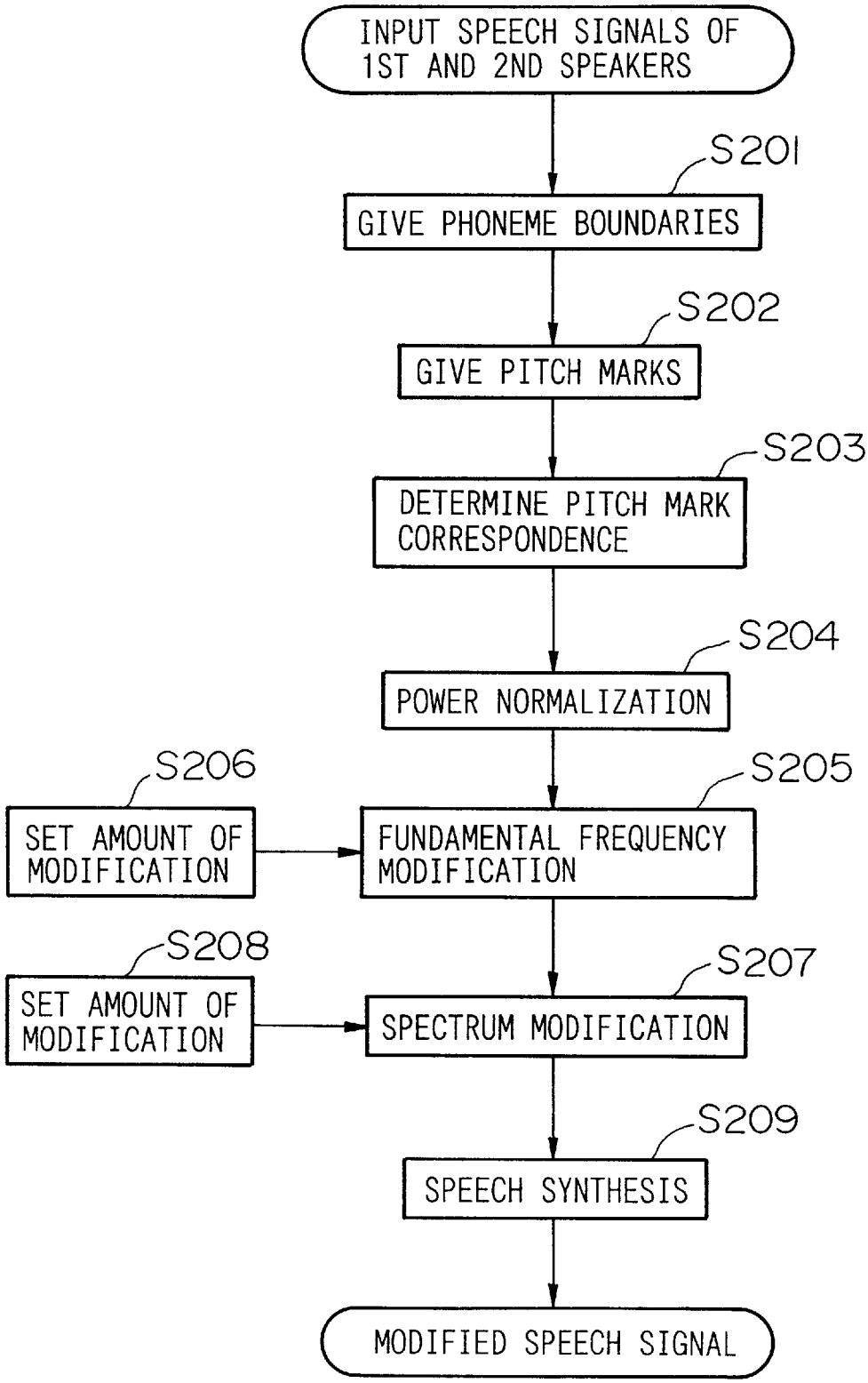
FIG. 2 is a flowchart showing the general procedure of the speech signal modification and concatenation method in the embodiment.

FIG. 2 is a flowchart showing the general procedure of the speech signal modification and concatenation method according to the present embodiment.

When speech signals spoken by two speakers are input, phoneme boundaries are given for each speech signal in step S201, and the processing proceeds to step S202.

In step S202, pitch marks indicating the fundamental period are given for each speech signal, and the processing proceeds to step S203.

Figure 3:
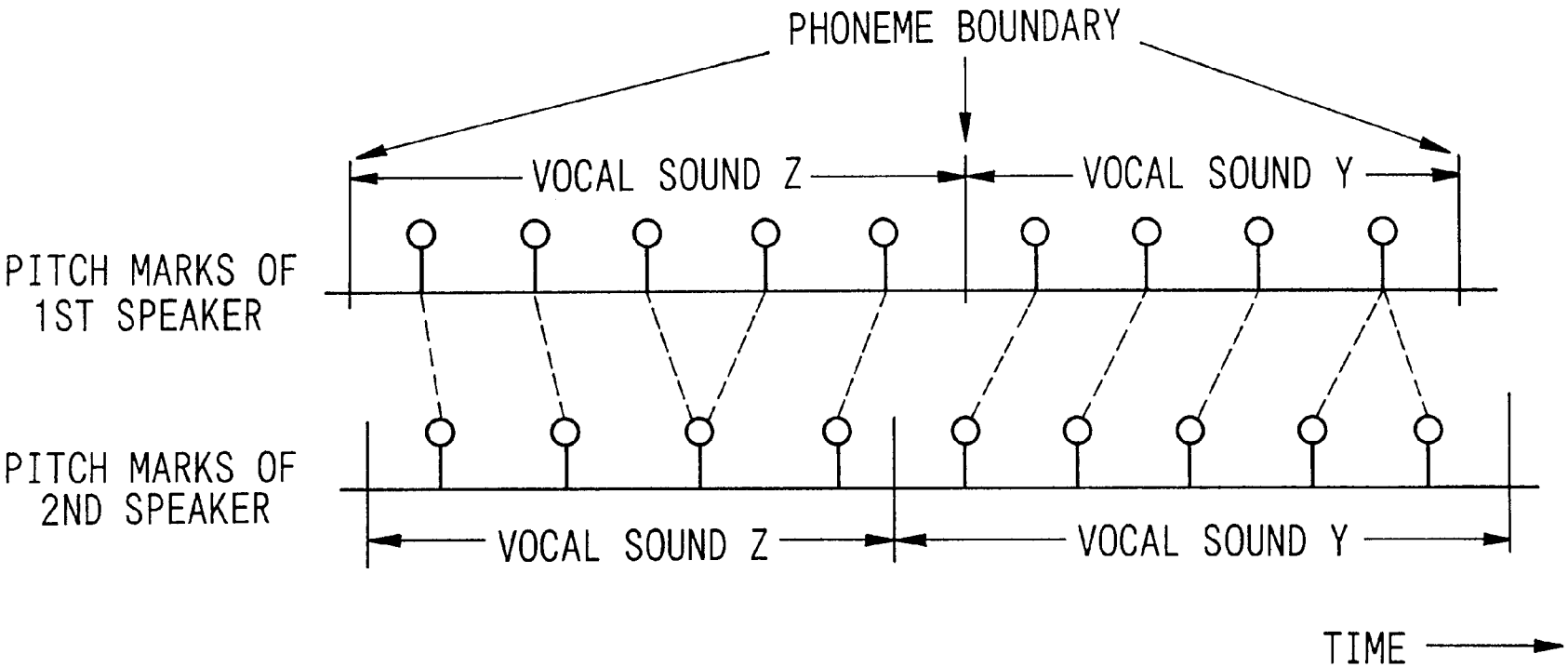
FIG. 3 is a diagram for explaining the pitch mark correspondence between the two speech signals in the embodiment.

In step S203, regarding the above pitch marks, each pitch mark correspondence is determined by choosing pitch marks existing most closely to each other, with respect to a corresponding voiced section of both speech signals. As a result, as shown by dashed lines in FIG. 3, one-to-one correspondence, one-to-many correspondence, or many-to-one correspondence can be obtained. These pitch mark correspondence relationships are stored in pitch-correspondence table 301 (refer to FIG. 4).

Next, in step S204, normalization of the power of the speech signals for each corresponding phoneme is performed.

The procedure up to this step may be separately and previously performed after the voice recording, or may be performed as a part of the modification and concatenating process.

Next, in step S205, the modification of the fundamental frequency of the speech signals is performed by a method described later, and the processing proceeds to step S207.

In step S207, the modification of the spectrum of the speech signals is performed by a method described later, and the processing proceeds to step S209.

Here, an amount of the modification of the fundamental frequency is set in step S206, while an amount of the modification of a boundary frequency (the spectrum modification is performed based on the boundary frequency) is set in step S208. These amounts are defined as functions with respect to time.

Finally, in step S209, two speech signals are totally synthesized, and a synthesized speech signal is obtained.

A number of methods have been proposed as a basic fundamental-frequency modification method which can be used in step S205. For example, the PSOLA method proposed in the following article can be used: E. Moulines and F. Charpentier, "Pitch-Synchronous Waveform Processing Techniques for Text-to-Speech Synthesis using Diphones", Speech Communication, Vol. 9, pp. 453–467, December, 1990.

Figure 4:
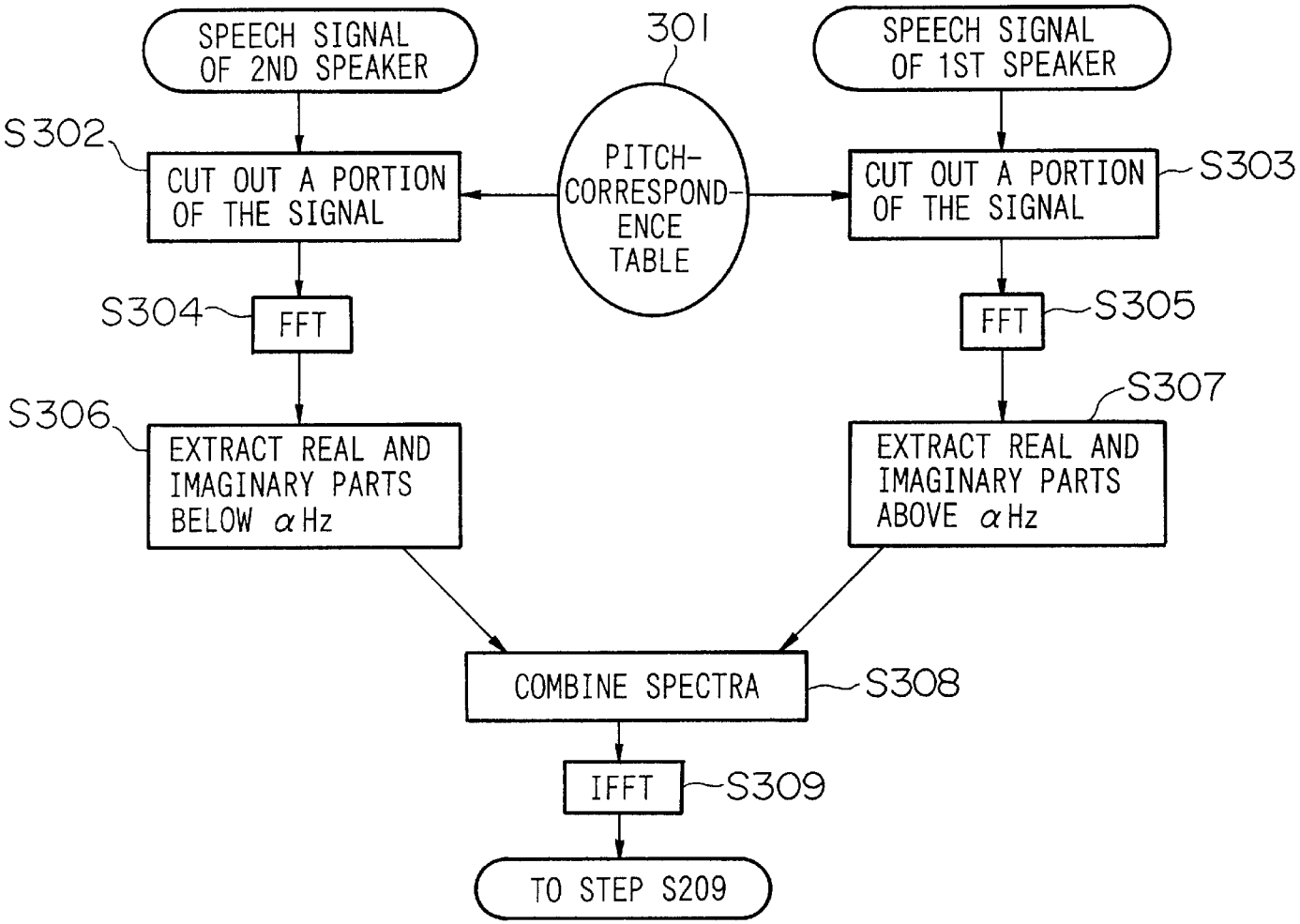
FIG. 4 is a flowchart showing an example of the spectrum modification procedure in the embodiment.

FIG. 4 is a flowchart showing an example of the spectrum modification procedure performed in the above step S207.

In the procedure, pitches corresponding to each other are selected from those of the speech signal of the second speaker (in step S302) and from those of the speech signal of the first speaker (in step S303) respectively, with reference to pitch-correspondence table 301 determined in the step S203 (refer to FIG. 2). Then, for each selected pitch, a speech waveform is cut out in synchronism with a pitch-synchronous signal. Here, an example in which the concatenation is performed under gradual voice-modification from the first speaker to the second speaker will be explained. In this case, a process relating to pitch synchronization is performed as many times as the number of the pitch marks. Here, if two pitch marks in the signal of the first speaker correspond to one pitch mark in the signal of the second speaker, as shown in an example of a vocal sound "Z" in FIG. 3, any one of the two pitch marks of the signal of the second speaker is referred to for the waveform cutting-out. On the other hand, if two pitch marks in the signal of the second speaker correspond to one pitch mark in the signal of the first speaker, as shown in an example of a vocal sound "Y" in FIG. 3, a speech waveform, which is referred to by the one pitch mark of the signal of the first speaker, is twice cut out.

Hereinbelow, the process for "one pitch" will be explained. First, in step S304, a spectrum analysis using FFT (Fast Fourier Transform) is performed for the speech waveform which was cut out in step S302.

On the other hand, in step S305, which is performed in parallel with step S304, a spectrum analysis using FFT is performed for the speech waveform which was cut out in step S303.

In step S306, from the spectrum of the second speaker obtained in step S304, a portion below a predetermined frequency $\alpha$ Hz is extracted.

On the other hand, in step S307, from the spectrum of the first speaker obtained in step S305, a portion above the predetermined frequency $\alpha$ Hz is extracted.

In step S308, the spectrum portions extracted in the steps S306 and S307 are combined with respect to frequency $\alpha$ Hz as a boundary point. In this spectrum-mixing operation, real and imaginary parts of each spectrum obtained by the FFT are respectively processed.

Finally, in step S309, IFFT (Inverse Fast Fourier Transform) analysis is performed for the spectrum obtained by the above mixture of the spectra, whereby a one-pitch waveform is obtained. The one-pitch waveform, obtained as explained above, is passed to the process of the above-explained step S209 (refer to FIG. 2).

Furthermore, by performing a similar spectrum-mixing process for each pitch while making the above boundary frequency gradually change, plural "one-pitch" waveforms are passed to the process of step S209 and are finally speech-synthesized in the step S209.

Figures 5A, 5B, 5C, 6A, 6B, 6C, 7A, 7B, 7C:
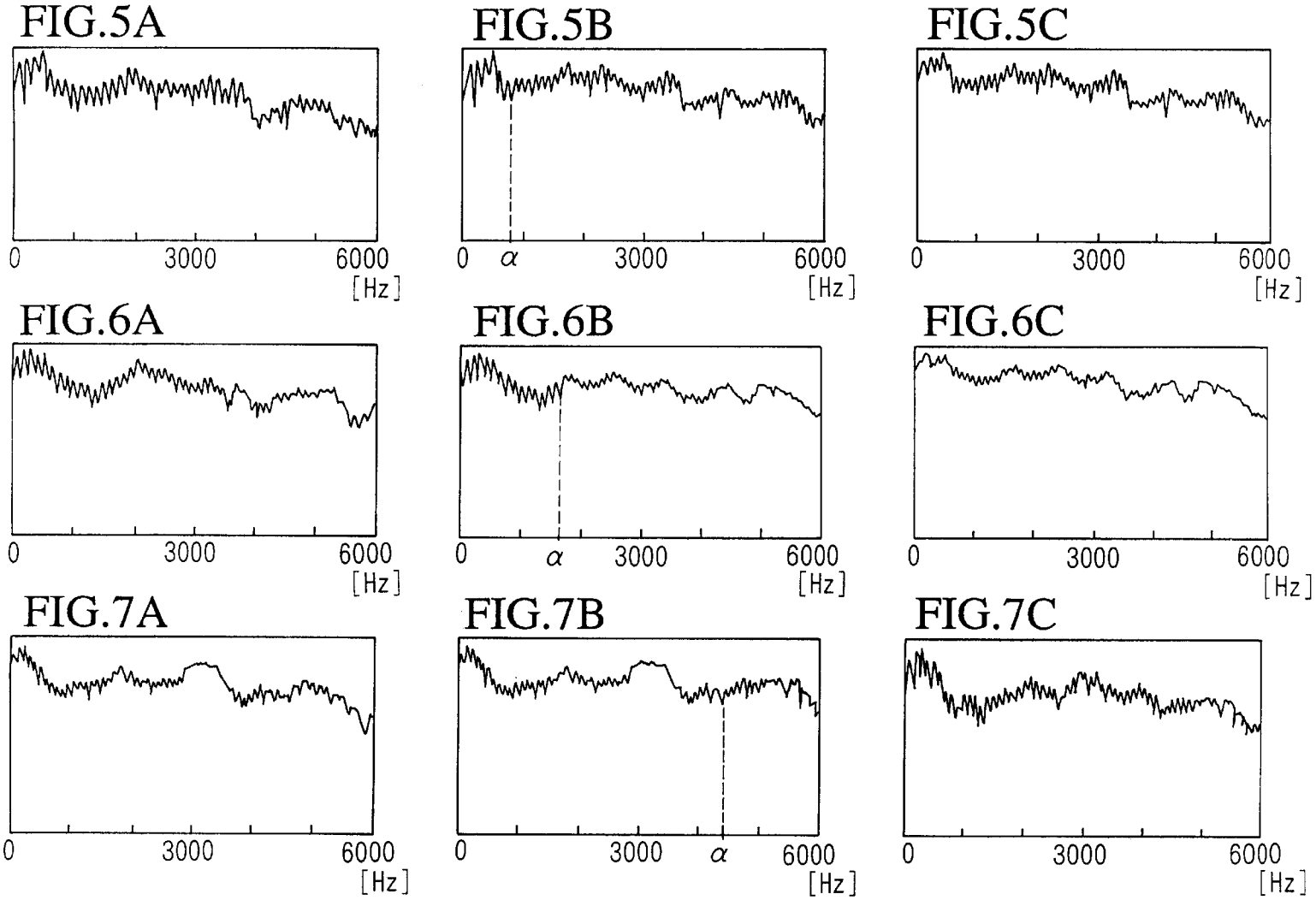
FIGS. 5A–5C are diagrams for explaining the setting of a boundary frequency at a time, and combination of two spectra with respect to the boundary frequency.
FIGS. 6A–6C are diagrams for explaining the resetting of the boundary frequency at a further-progressed time, and combination of two spectra with respect to the boundary frequency.
FIGS. 7A–7C are diagrams for explaining the resetting of the boundary frequency at a further-progressed time, and combination of two spectra with respect to the boundary frequency.

FIGS. 5A–5C, 6A–6C, and 7A–7C are for the purpose of showing an example of the spectra mixture with time-scaled transition of the boundary frequency. In the example, boundary frequency a is changed in three stages, in the order of those indicated in FIG. 5B →FIG. 6B →FIG. 7B. Here, the spectrum of the second speaker in each stage, the lower portion of which is extracted, is shown in FIGS. 5A, 6A, and 7A, while the spectrum of the first speaker in each stage, the upper portion of which is extracted, is shown in FIGS. 5C, 6C, and 7C, and the mixed spectrum obtained by combining the spectra in each stage is shown in FIGS. 5B, 6B, and 7B.

Figure 8:
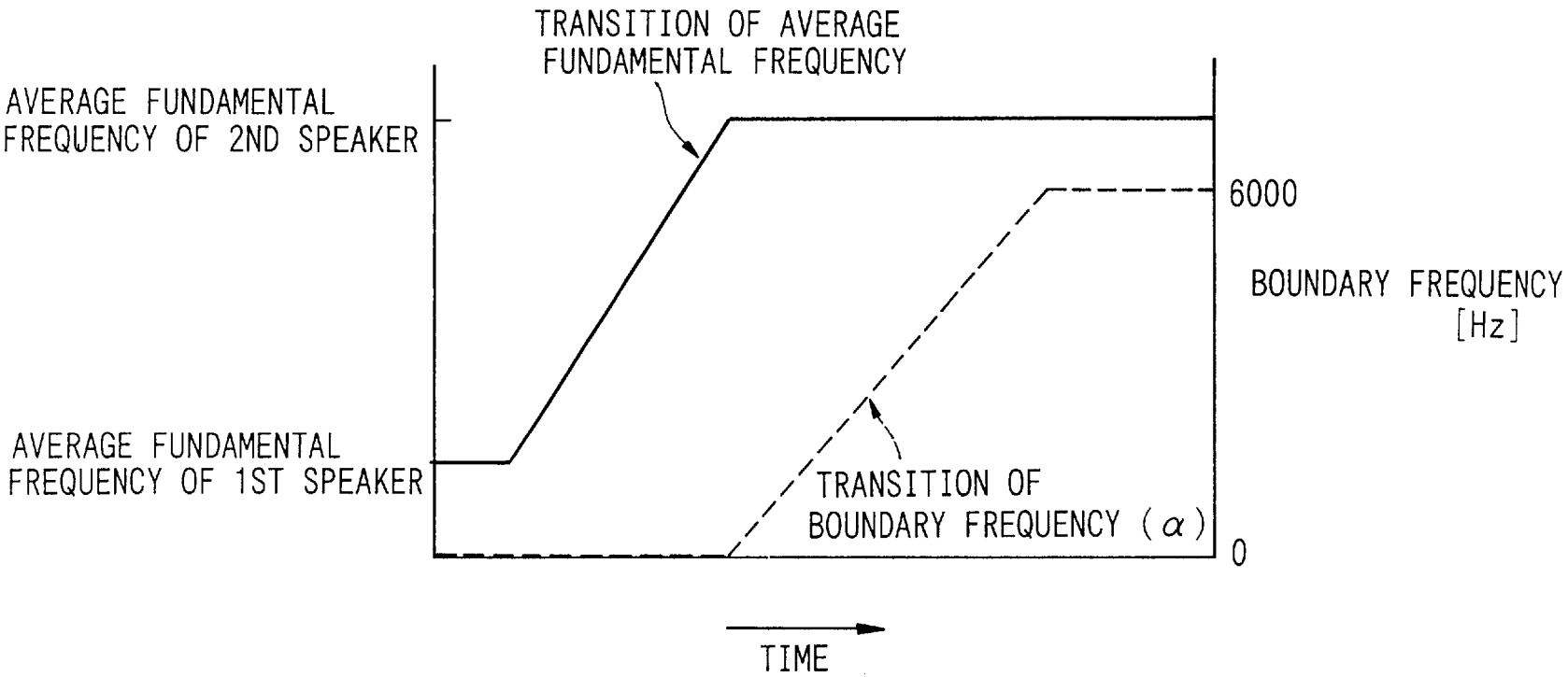
FIG. 8 is a graph chart showing the time-scaled transitions of the average fundamental frequency and the boundary frequency.

FIG. 8 is a graph chart showing the time-scaled transitions of (i) the average fundamental frequency (changed in the fundamental frequency modification process of step S205) and (ii) the boundary frequency (changed in the spectrum modification process of step S207), in the speech signal modification and concatenation procedure according to the present embodiment.

In this embodiment, the control of the modification of the fundamental frequency of spoken sounds is performed in a manner such that an average fundamental frequency of each of the speech signals of the first and second speakers is previously calculated, and a frequency value to be changed per unit time (for the fundamental frequency) is determined based on (i) the difference between both average fundamental frequencies and (ii) a predetermined period for parameter-modification (that is, the period for the modification and concatenation). Under these conditions, the fundamental frequency in the modification and concatenation period is gradually changed from one to the other of the above two average fundamental frequencies at a time-scaled fixed rate, as shown in FIG. 8.

On the other hand, the control of the modification of the spectrum of spoken sounds is performed such that the boundary frequency $\alpha$ is gradually changed at a time-scaled fixed rate.

Here, an amount of the change for the average fundamental frequency is set in step S206, and an amount of the change for the boundary frequency is set in step S208.

Figures 9A, 9B, 9C:
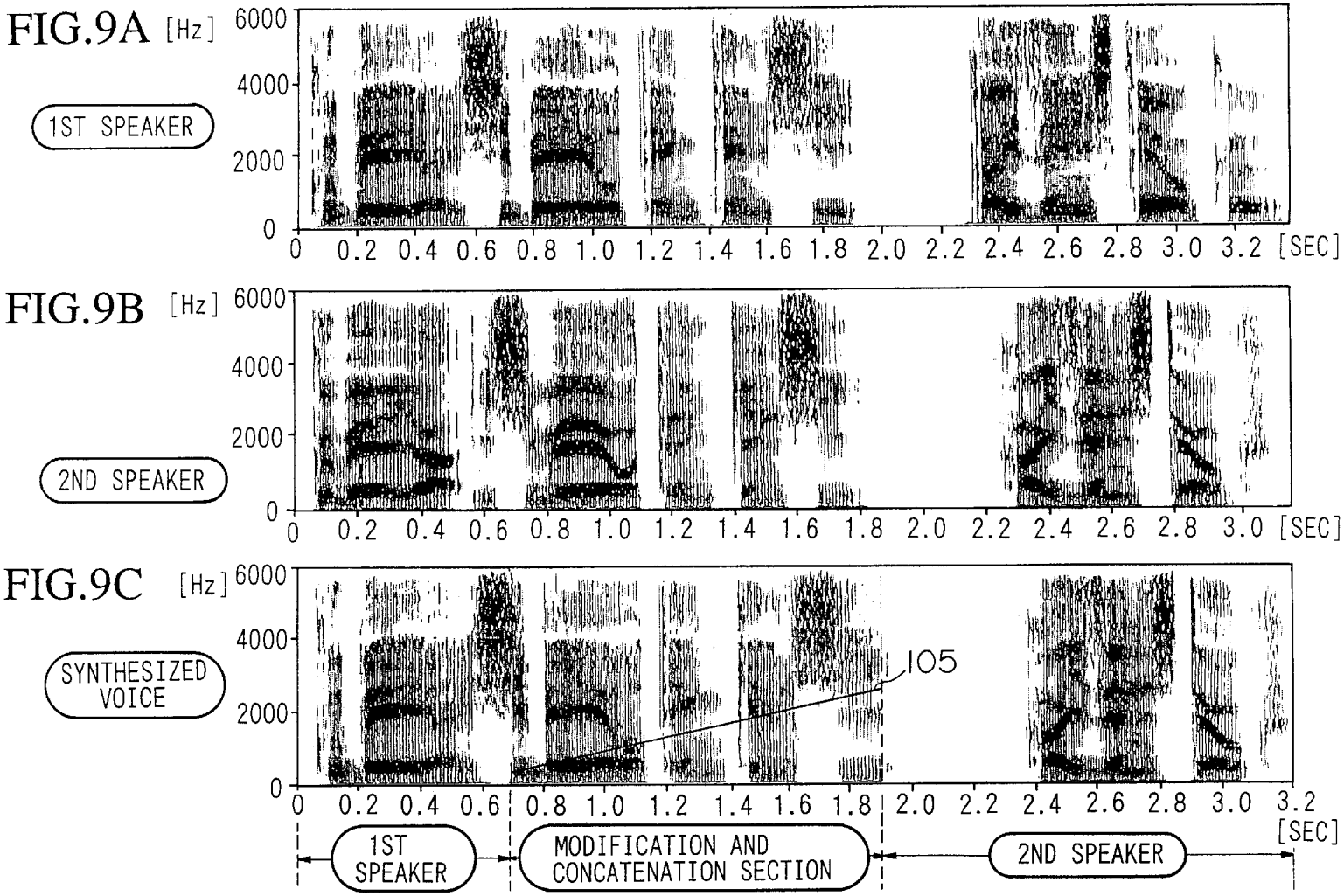
FIGS. 9A–9C are spectrograms showing the voiceprints obtained by each speech signal shown in FIGS. 1A–1C.

FIGS. 9A–9C are spectrograms corresponding to FIGS. 1A–1C, showing the voiceprints obtained by each speech signal. In each spectrogram, the horizontal axis indicates time (sec), while the vertical axis indicates frequency (Hz), and the density level at each point of intersection of the "time" and "frequency" indicates a power of the spectrum at the relevant time (although the "density" cannot be clearly shown in the drawing). Additionally, for the synthesized voice in the modification and concatenation section shown in FIG. 9C, the transition of the boundary frequency in the section is shown by the line indicated by reference numeral 105.

In addition, the rate of changing such speech parameters is not necessarily fixed, but various patterns of change may be adopted.

Figure 10:
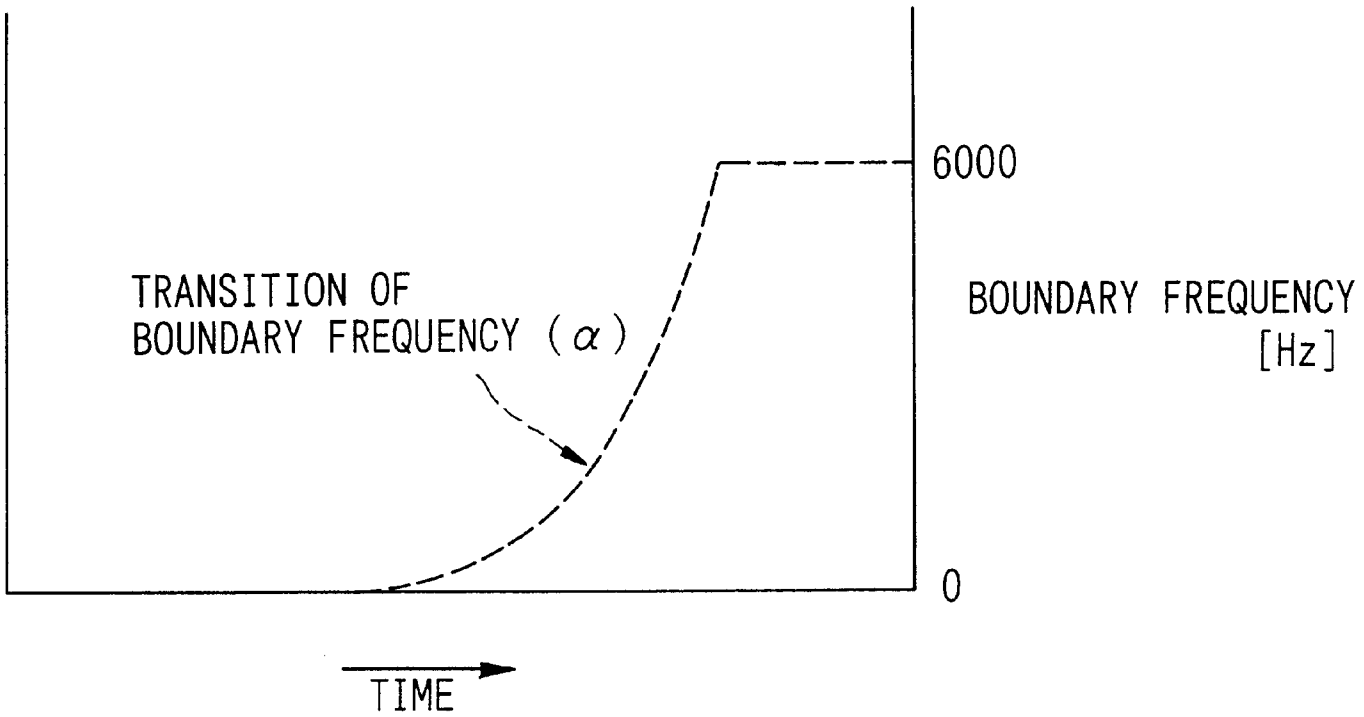
FIG. 10 is a graph chart showing another pattern of change with respect to the boundary frequency.

For example, another pattern of change with respect to boundary frequency $\alpha$ is shown in FIG. 10. In this example, the change is slow in a stage of relatively low boundary frequencies, and the change gradually increases as the boundary frequency increases. The sense of hearing of humans has a characteristic in which lower frequencies are more significantly (or keenly) sensed than higher frequencies; thus, by adapting such a pattern of change as in this example, a more fixed rate of change for human hearing, that is, a more natural change of voice characteristics, can be realized.

As described above, the embodiments according to the present invention were explained in detail with reference to the drawings; however, concrete examples are not limited by these embodiments, and any example with design modifications within the scope of the present invention is regarded as being based on the present invention.

For example, in the above-explained embodiment, the fundamental frequency is modified first, and the speech spectrum is modified next; however, the order of the modification may be the opposite of that in the embodiment, or these speech parameters may be simultaneously modified by using a distributed data processing or the like. Additionally, if the modification period is long, smoother concatenation can be realized by separately modifying these parameters.

In addition, the two speech signals to be modified and concatenated may be those obtained by vocalizations of speech-synthesis devices instead of those produced by humans. Alternatively, a speech signal obtained by vocalizations of a speech-synthesis device and a speech signal obtained by vocalizations of a human may be concatenated.

In the above explanation, the feature is emphasized in that a sense of incompatibility is not caused for listeners even if spoken sounds (spoken messages) of different speakers are concatenated. However, the present invention can also be used for making listeners be "aware of" a voice change without a sense of incompatibility, as well as making listeners be completely unaware of a voice change. For example, in an image-processing technique called "morphing", still images of a man and a woman are used, and it is possible to gradual change the man's face into the woman's face (by progressively processing the man's face image into the woman's face image over time). By using such an image-processing technique together with the method according to the present invention, it is possible to realize a simulation in which a human face is changed from a man to a woman, and simultaneously the voice is also changed from a man's to a woman's so that the viewer is not aware of any incongruity. Such a simulation will produce a surprising effect for the viewer (or listener). These kinds of techniques can be used to produce novel ability of expression in such fields as movie or multimedia production.

What is claimed is:

1. A speech signal modification and concatenation method for concatenating two spoken speech signals having different speaker individuality, each spoken speech signal consisting of a plurality of phonemes and communicating a predetermined message including a plurality of words, said method comprising the step of:

concatenating the speech signals by modifying a parameter indicating a characteristic of the speech signals in a manner such that the parameter is gradually changed from a value indicating a feature of one of the speech signals to a value indicating a feature of the other speech signal over a predetermined period, the concatenated signal having a first section corresponding to the one of the speech signals, a second section corresponding to said predetermined period, and a third section corresponding to the other speech signal, wherein a listener listening to a spoken message including a plurality of words hears said first, second, and third sections in turn.

2. A speech signal modification and concatenation method as claimed in claim 1, wherein the modification of the parameter is performed by using two kinds of speech data, the data being obtained by making two speakers who have the different voice characteristics read the same text aloud over the predetermined period for the change of the parameter.

3. A speech signal modification and concatenation method as claimed in claim 1, wherein the two speech signals having different voice characteristics are obtained by vocalizations of speech-synthesis devices.

4. A speech signal modification and concatenation method as claimed in claim 1, wherein one of the two speech signals having different voice characteristics is obtained by vocalizations of a human and the other speech signal is obtained by vocalizations of a speech-synthesis device.

5. A speech signal modification and concatenation method as claimed in claim 1, wherein the parameter is a spectrum of spoken sounds, and the spectrum is gradually changed over the predetermined period.

6. A speech signal modification and concatenation method as claimed in claim 5, wherein the change of the spectrum comprises the steps of:

in a phoneme which corresponds to the two speech signals, determining each pitch correspondence between the two signals;

generating a spectrum, for every corresponding pitch, by combining, with respect to a boundary frequency, a portion above the boundary frequency among the spectrum of one speech signal and a portion below the boundary frequency among the spectrum of the other speech signal, and determining the generated spectrum as a spectrum at the relevant pitch; and with respect to the generation of spectra, changing the boundary frequency for each unit time.

7. A speech signal modification and concatenation method as claimed in claim 6, wherein the change of the boundary frequency is performed such that the boundary frequency increases by a fixed amount for each unit time.

8. A speech signal modification and concatenation method as claimed in claim 6, wherein the change of the boundary frequency is performed such that:

the boundary frequency gradually increases from a value at the start of change to a value at the end of change; and the rate of change is lower in a stage of relatively low boundary frequencies near the start of change, while the rate of change is higher in a stage of relatively high boundary frequencies near the end of change.

9. A speech signal modification and concatenation method as claimed in claim 1, wherein the parameter is a fundamental frequency of spoken sounds, and the fundamental frequency is gradually changed in the predetermined period.

10. A speech signal modification and concatenation method as claimed in claim 9, wherein the change of the fundamental frequency comprises the steps of:

calculating an average fundamental frequency of each speech signal;

determining a frequency value to be changed per unit time for the fundamental frequency, based on the difference between the two average fundamental frequencies and the predetermined period for the change of the parameter; and with the determined value as a unit of the amount of change, changing the fundamental frequency for each unit time such that the fundamental frequency is modified from the average fundamental frequency of one speech signal to that of the other speech signal.

11. A speech signal modification and concatenation method as claimed in claim 1, wherein each of a spectrum of spoken sounds and a fundamental frequency of spoken sounds is used as the parameter, and:

the change of the spectrum comprises the steps of:

in a phoneme which corresponds to the two speech signals, determining each pitch correspondence between the two signals;

generating a spectrum, for every corresponding pitch, by combining, with respect to a boundary frequency, a portion above the boundary frequency among the spectrum of one speech signal and a portion below the boundary frequency among the spectrum of the other speech signal, and determining the generated spectrum as a spectrum at the relevant pitch; and with respect to the generation of spectra, changing the boundary frequency for each unit time, and the change of the fundamental frequency comprises the steps of:

calculating an average fundamental frequency of each speech signal;

determining a frequency value to be changed per unit time for the fundamental frequency, based on the difference between the two average fundamental frequencies and the predetermined period for the change of the parameter; and with the determined value as a unit of the amount of change, changing the fundamental frequency for each unit time such that the fundamental frequency is modified from the average fundamental frequency of one speech signal to that of the other speech signal.

12. A speech signal modification and concatenation method as claimed in claim 11, wherein the spectrum of spoken sounds and the fundamental frequency of spoken sounds are changed in parallel.

* * * * *